US010384693B2

(12) United States Patent
Wu et al.

(10) Patent No.: US 10,384,693 B2
(45) Date of Patent: Aug. 20, 2019

(54) SIDE WALL STRUCTURE OF OPEN WAGON

(71) Applicant: CRRC YANGTZE CO., LTD., Wuhan (CN)

(72) Inventors: Huiping Wu, Wuhan (CN); Yaoming Hu, Wuhan (CN); Huarui Zhao, Wuhan (CN); Yan He, Wuhan (CN); Liangcai Lin, Wuhan (CN); Chuqiang Tang, Wuhan (CN)

(73) Assignee: CRRC YANGTZE CO., LTD., Wuhan (CN)

( * ) Notice: Subject to any disclaimer, the term of this patent is extended or adjusted under 35 U.S.C. 154(b) by 125 days.

(21) Appl. No.: 15/525,272

(22) PCT Filed: Oct. 22, 2015

(86) PCT No.: PCT/CN2015/092528
§ 371 (c)(1),
(2) Date: May 8, 2017

(87) PCT Pub. No.: WO2016/086732
PCT Pub. Date: Jun. 9, 2016

(65) Prior Publication Data

US 2017/0320504 A1 Nov. 9, 2017

(30) Foreign Application Priority Data

Dec. 4, 2014 (CN) ..... 2014 1 0735198

(51) Int. Cl.
*B61D 17/08* (2006.01)
*B61D 3/00* (2006.01)

(52) U.S. Cl.
CPC ..... *B61D 17/08* (2013.01); *B61D 3/00* (2013.01)

(58) Field of Classification Search
CPC ..... B61D 3/00; B61D 17/08
See application file for complete search history.

(56) References Cited

U.S. PATENT DOCUMENTS 4,254,714 A * 3/1981 Heap ..... B61D 7/00 105/364
4,637,320 A * 1/1987 Paton ..... B61D 9/06 105/3

(Continued)

FOREIGN PATENT DOCUMENTS

CN 201347069 Y 11/2009
CN 103010238 A 4/2013

(Continued)

*Primary Examiner* — Jason C Smith
(74) *Attorney, Agent, or Firm* — Platinum Intellectual Property LLP

(57) ABSTRACT

A side wall structure of an open wagon includes an upper side beam (1), wherein built-in pillow columns (3) and built-in side columns (4) are arranged on the inner side of the upper side beam (1), the upper side beam (1) is formed by pressing an outer side flanged plate (1*a*), an upper planar plate (1*b*), an inner side slope plate (1*c*) and a lower vertical plate (1*d*), the upper parts of the built-in pillow columns (3) and the built-in side columns (4) are welded on the inner side slope plate (1*c*) and the lower vertical plate (1*d*), built-in small upright columns (5) are respectively arranged on the outer sides of the built-in pillow columns (3), between the built-in pillow columns (3) and the built-in side columns (4) that are adjacent and between every two adjacent built-in side columns (4), and the upper parts of the built-in small upright column (5) are welded on the inner side slope plate (1*c*) and the lower vertical plate (1*d*); each side wall plate (2) includes a straight side wall plate (2*a*) and arc-shaped plates (2*b*), a part of the lower parts of the built-in pillow columns (3), a part of the lower parts of the built-in side columns (4) and the entire lower parts of the built-in small upright columns (5) are respectively welded on the straight side wall plate (2*a*), a plurality of arc-shaped plates (2*b*) are respectively welded between the built-in pillow columns (3) and the built-in side columns (4) that are adjacent and between (Continued)

every two adjacent built-in side columns (4), an upper end of the straight side wall plate (2*a*) is in butt joint with a lower end of the lower vertical plate (1*d*), the lower end of the straight side wall plate (2*a*) is in butt joint with the upper ends of the arc-shaped plates (2*b*), and the lower ends of the arc-shaped plates (2*b*) are welded with a wagon body floor.

10 Claims, 5 Drawing Sheets

(56) References Cited

U.S. PATENT DOCUMENTS 4,771,705 A * 9/1988 Przybylinski ..... B61D 9/06 105/404
5,373,792 A * 12/1994 Pileggi ..... B61D 17/04 105/406.1
6,877,440 B1 * 4/2005 Kilian ..... B60P 1/286 104/247
6,978,720 B2 * 12/2005 Johnson ..... B61D 17/08 105/380
2007/0101895 A1 * 5/2007 Forbes ..... B61D 17/00 105/406.1
2007/0101896 A1 * 5/2007 Forbes ..... B61D 17/00 105/406.1
2007/0277696 A1 * 12/2007 Forbes ..... B61D 9/00 105/406.1
2010/0011987 A1 * 1/2010 Forbes ..... B61D 17/08 105/406.1
2017/0320504 A1 * 11/2017 Wu ..... B61D 3/00

FOREIGN PATENT DOCUMENTS

CN 203005434 U 6/2013
CN 203419136 U 2/2014
CN 204250062 U 4/2015
CN 104590296 A 5/2015
DE 19618600 A1 11/1997
JP 2012081874 A 4/2012

* cited by examiner

SIDE WALL STRUCTURE OF OPEN WAGON

FIELD OF THE INVENTION

The present invention relates to the field of open wagons, in particular to the field of railway open wagons, and specifically relates to a side wall structure of an open wagon.

BACKGROUND OF THE INVENTION

Railway open wagons are main wagons in railway transportation and occupy the largest number of existing railway wagons, and the open wagons are mainly responsible for the delivery of coal, ores, mine construction materials, timbers, steel and other bulk cargos and can also be used for transporting some heavy mechanical equipment. The railway open wagons can be divided into two categories according to different unloading manners: open wagons suitable for manual or mechanical loading and unloading operations, and open wagons suitable for fixed groupage traffic in columns between large industrial and mining enterprises, stations and docks, and open wagons unloading through car dumpers.

With the development of railway freight toward heavy-haul transportation, increasing the axle weight and increasing the single-wagon load have become the most effective and consistently adopted common measures in countries around the world. The open wagons, especially the railway open wagons, develop toward the direction of increasing the axle weight and increasing the load of every linear meter accordingly, and the weights of the wagon bodies are increased correspondingly.

At present, the wagon body of a railway ore open wagon is mainly composed of an underframe, end walls and side walls. The underframe is mainly formed by installing and welding of a middle beam, a pillow beam, a cross beam, a longitudinal beam and a floor, each end wall is mainly formed by installing and welding of an end plate, an upper end beam, a platband and a corner column, each side wall is mainly formed by installing and welding of an upper side beam, a pillow column, a side column and a side wall plate, and the underframe, the end walls and the side walls are jointly enclosed to form a cargo loading space and an overall bearing structure. The end walls and the side walls are mainly used for bearing lateral pressures of loaded cargos and a transverse force generated by the wagon in a running process, and in particular, the longitudinal side wall needs to bear larger pressure, so the side wall must have enough strength and rigidity to ensure the running safety of the railway open wagon.

In order to solve the above problems, Chinese Patent No. 201220680175.8 discloses a railway ore open wagon body side wall, which improves the strength and the rigidity of side walls by the following technical solution: a built-in pillow column and a built-in side column are additionally arranged at positions corresponding to a pillow beam and a cross beam on an upper side beam respectively, and side wall plates of small block structures are installed and welded between the built-in pillow column and the built-in side column. However, this technical solution has the following problems during actual construction and use:

1, because the distance between the pillow beam and the cross beam is large, the distance between the built-in pillow column and the built-in side column is larger too, in this way, the effect of improving the strength and the rigidity of the side walls by the built-in pillow column and the built-in side column is limited, and accordingly in actual construction, to ensure enough strength and rigidity of the side walls, the side wall plates must be pressed to further improve the strength and the rigidity of the side walls, which increases the workload and reduces the assembly efficiency; and 2, because the side wall plates are of the small block structures, multiple side wall plates must be pressed respectively during the construction and then are installed and assembled, thereby increasing the number of assembled parts, increasing the workload and reducing the assembly efficiency; and the strength of the installed and welded side wall structure is relatively low.

SUMMARY OF THE INVENTION

The objective of the present invention is to provide a side wall structure of an open wagon, which has strong bearing capacity and high assembly efficiency, in order to overcome the shortcomings in the above-mentioned background art.

To achieve the above-mentioned objective, the side wall structure of the open wagon designed in the present invention includes an upper side beam and side wall plates, wherein built-in pillow columns and built-in side columns are arranged on the inner side of the upper side beam along the longitudinal direction, the upper side beam is formed by integrally pressing an outer side flanged plate, an upper planar plate, an inner side slope plate and a lower vertical plate, open edges at upper parts of the built-in pillow columns and the built-in side columns are welded on the inner side slope plate and the lower vertical plate, built-in small upright columns are respectively arranged on the outer sides of the built-in pillow columns, between the built-in pillow columns and the built-in side columns that are adjacent and between every two adjacent built-in side columns, and the open edges of the upper parts of the built-in small upright column are also welded on the inner side slope plate and the lower vertical plate; and each side wall plate includes a straight side wall plate of a flat plate structure on the whole and arc-shaped plates of arc-shaped small block structures, the open edges of a part of the lower parts of the built-in pillow columns, a part of the lower parts of the built-in side columns and the entire lower parts of the built-in small upright columns are respectively welded on the straight side wall plate, a plurality of arc-shaped plates are respectively welded between the built-in pillow columns and the built-in side columns that are adjacent and between every two adjacent built-in side columns, an upper end of the straight side wall plate is in butt joint with a lower end of the lower vertical plate, the lower end of the straight side wall plate is in butt joint with the upper ends of the arc-shaped plates, and the lower ends of the arc-shaped plates are welded with a wagon body floor. The built-in small upright columns are respectively arranged on the outer sides of the built-in pillow columns, between the built-in pillow columns and the built-in side columns that are adjacent and between every two adjacent built-in side columns to reinforce the support to the side wall plate so as to greatly improve the strength and the rigidity of the side wall structure, in this way, the side wall plate does not need to be pressed anymore, thereby reducing the workload and improving the assembly efficiency; and meanwhile, as the side wall plate is designed into the structure composed of the straight side wall plate and the arc-shaped plates, the upper part of the side wall plate is of an integral structure, thereby improving the strength and the rigidity of the side wall structure; moreover, after the upper part of the side wall plate is designed into the integral structure, the number of the assembled parts is reduced, and the assembly efficiency is improved.

In the above-mentioned solution, one built-in small upright column is respectively arranged on the outer sides of the built-in pillow columns, and two built-in small upright columns are respectively arranged between the built-in pillow columns and the built-in side columns that are adjacent and between every two adjacent built-in side columns.

In the above-mentioned solution, the lower ends of the built-in small upright columns are connected with the arc-shaped plates by a base, the base is formed by splicing two base arc-shaped plates and one base connecting plate, arc-shaped side edges of the base arc-shaped plates are matched with the arc-shaped plates, the upper end of the base is in butt joint with the lower ends of the built-in small upright columns, and an arc-shaped opening of the base is in butt joint with the arc-shaped plates. As the base is additionally arranged at the lower ends of the built-in small upright columns, the base connects the built-in small upright columns, the straight side wall plate and the arc-shaped plates into an entirety, thereby further improving the strength and the rigidity of the side wall structure.

In the above-mentioned solution, small cross beams connected with a longitudinal wagon body beam are respectively arranged at positions corresponding to the built-in small upright columns on the bottom surface of the wagon body floor. As the small cross beams connected with the longitudinal wagon body beam are respectively arranged at positions corresponding to the built-in small upright columns on the bottom surface of the wagon body floor, the stress applied to the side wall plate can be transferred onto the small cross beams by the built-in small upright columns, the base and the arc-shaped plates and is finally transferred onto the longitudinal wagon body beam by the small cross beams, thereby improving the load that can be born by the side wall structure.

In the above-mentioned solution, force transfer plates are respectively arranged at positions corresponding to the built-in small upright columns on the outer sides of the arc-shaped plates, the upper ends of the force transfer plates are welded on the outer sides of the arc-shaped plates, and the lower ends of the force transfer plates are welded with the small cross beams. The additionally arranged force transfer plates can better transfer the stress applied to the side wall plate to the small cross beams, thereby further improving the load that can be born by the side wall structure.

In the above-mentioned solution, intermediate wagon backup plates are respectively arranged at positions corresponding to the built-in small upright columns on the outer side of the straight side wall plate, the upper ends of the intermediate wagon backup plates are welded on the straight side wall plate, and the lower ends of the intermediate wagon backup plates are welded on the force transfer plates. The additionally arranged intermediate wagon backup plates can effectively prevent a car dumper and other mechanical equipment from damaging the side wall structure in loading and unloading of cargos.

In the above-mentioned solution, pillow column connecting bases are arranged on the outer sides of the upper parts of the built-in pillow columns, the upper ends of the pillow column connecting bases are in welded connection with the lower end of the outer side flanged plate, and the lower ends of the pillow column connecting bases are in welded connection with the lower end of the inner side slope plate; and pillow column sealing plates are arranged at the outer sides of the lower parts of the built-in pillow columns, the upper ends of the pillow column sealing plates are in welded connection with the lower end of the straight side wall plate, and the inner sides of the lower ends of the pillow column sealing plates are welded with the open edges of the built-in pillow columns and the end parts of wagon body pillow beams at the same time. The additionally arranged pillow column connecting bases and the pillow column sealing plates increase the overall strength and the rigidity of the side wall structure to enable the side wall structure to uniformly bear the lateral pressures of the loaded cargos and the transverse force of the running wagon on one hand, and improve the aesthetic feeling of the appearance design and the cleanness of the wagon body on the other hand.

In the above-mentioned solution, side column connecting bases are arranged on the outer sides of the upper parts of the built-in side columns, the upper ends of the side column connecting bases are welded with the outer side flanged plate, and the lower ends of the side column connecting bases are welded with the lower end of the inner side slope plate; and side column sealing plates are arranged at the outer sides of the lower parts of the built-in side columns, the upper ends of the side column sealing plates are welded with the lower end of the straight side wall plate, and the inner sides of the lower ends of the side column sealing plates are welded with the open edges of the built-in side columns and the end parts of cross wagon body beams at the same time. The additionally arranged side column connecting bases and the side column sealing plates increase the overall strength and the rigidity of the side wall structure to enable the side wall structure to uniformly bear the lateral pressures of the loaded cargos and the transverse force of the running wagon on one hand, and improve the aesthetic feeling of the appearance design and the cleanness of the wagon body on the other hand.

In the above-mentioned solution, a horizontally arranged sealing plate is arranged at the lower end of the outer side flanged plate, one side edge of the sealing plate is in butt joint with the lower end of the outer side flanged plate, the other side edge of the sealing plate is in butt joint with an outer side face of the inner side slope plate, and the outer side flanged plate, the upper planar plate, the inner side slope plate and the sealing plate form a closed cavity. As the flanging structure of the upper side beam is sealed by the sealing plate to form the closed cavity, the strength and the rigidity of the upper side beam are greatly improved.

In the above-mentioned solution, angle irons for connecting end walls are respectively arranged at both ends of the upper side beam. After the built-in small upright columns are additionally arranged and the flanging structure of the upper side beam is closed, the strength and the rigidity of the side wall structure are greatly improved, therefore the corner columns necessary for installing the end walls can be cancelled. However, to ensure the strength, the angle irons for connecting the end walls are still arranged at both ends of the upper side beam of the side wall structure, thereby greatly simplifying the structure of the wagon body and improving the assembly efficiency on the premise of guaranteeing the strength and the rigidity.

The present invention has the following advantages:

1. the built-in small upright columns are respectively arranged on the outer sides of the built-in pillow columns, between the built-in pillow columns and the built-in side columns that are adjacent and between every two adjacent built-in side columns to reinforce the support to the side wall plate so as to greatly improve the strength and the rigidity of the side wall structure, in this way, the side wall plate does not need to be pressed anymore, thereby reducing the workload and improving the assembly efficiency;

2. as the side wall plate is designed into the structure composed of the straight side wall plate and the arc-shaped plates, the upper part of the side wall plate is of an integral structure, thereby improving the strength and the rigidity of the side wall structure; moreover, after the upper part of the side wall plate is designed into the integral structure, the number of the assembled parts is reduced, and the assembly efficiency is improved;

3. as the base is additionally arranged at the lower ends of the built-in small upright columns, the base connects the built-in small upright columns, the straight side wall plate and the arc-shaped plates into an entirety, thereby further improving the strength and the rigidity of the side wall structure;

4. as the small cross beams connected with the longitudinal wagon body beam are respectively arranged at positions corresponding to the built-in small upright columns on the bottom surface of the wagon body floor, the stress applied to the side wall plate can be transferred onto the small cross beams by the built-in small upright columns, the base and the arc-shaped plates and is finally transferred onto the longitudinal wagon body beam by the small cross beams, thereby improving the load that can be born by the side wall structure;

5. the additionally arranged force transfer plates can better transfer the stress applied to the side wall plate to the small cross beams, thereby further improving the load that can be born by the side wall structure;

6. the additionally arranged intermediate wagon backup plates can effectively avoid the car dumper and other mechanical equipment from damaging the side wall structure when loading and unloading cargos;

7. the additionally arranged pillow column connecting bases, the pillow column sealing plates, the side column connecting bases and the side column sealing plates increase the overall strength and the rigidity of the side wall structure to enable the side wall structure to uniformly bear the lateral pressures of the loaded cargos and the transverse force of the running wagon on one hand, and improve the aesthetic feeling of the appearance design and the cleanness of the wagon body on the other hand;

8. as the flanging structure of the upper side beam is sealed by the sealing plate to form the closed cavity, the strength and the rigidity of the upper side beam are greatly improved; and 9. after the built-in small upright columns are additionally arranged and the flanging structure of the upper side beam is closed, the strength and the rigidity of the side wall structure are greatly improved, therefore the corner columns necessary for installing the end walls can be cancelled, however, to ensure the strength, the angle irons for connecting the end walls are still arranged at both ends of the upper side beam of the side wall structure, thereby greatly simplifying the structure of the wagon body and improving the assembly efficiency on the premise of guaranteeing the strength and the rigidity.

The foregoing description is merely an overview of the technical solutions of the present invention and can be implemented in accordance with the contents of the specification in order to enable a clearer and easier understanding of the technical means of the present invention, and to make the above-mentioned and other objectives, features and advantages of the present invention more obvious, specific embodiments of the present invention will be particularly described below.

BRIEF DESCRIPTION OF THE DRAWINGS

Various other advantages and beneficial effects will become apparent to those of ordinary skill in the art upon reading the following detailed description of the preferred embodiments. The drawings are for the purpose of merely illustrating the preferred embodiments and are not to be construed as limit to the present invention. Moreover, the same reference signs are used for designating the same components throughout the accompanying drawings, in which.

REFERENCE SIGNS

Figure 1:
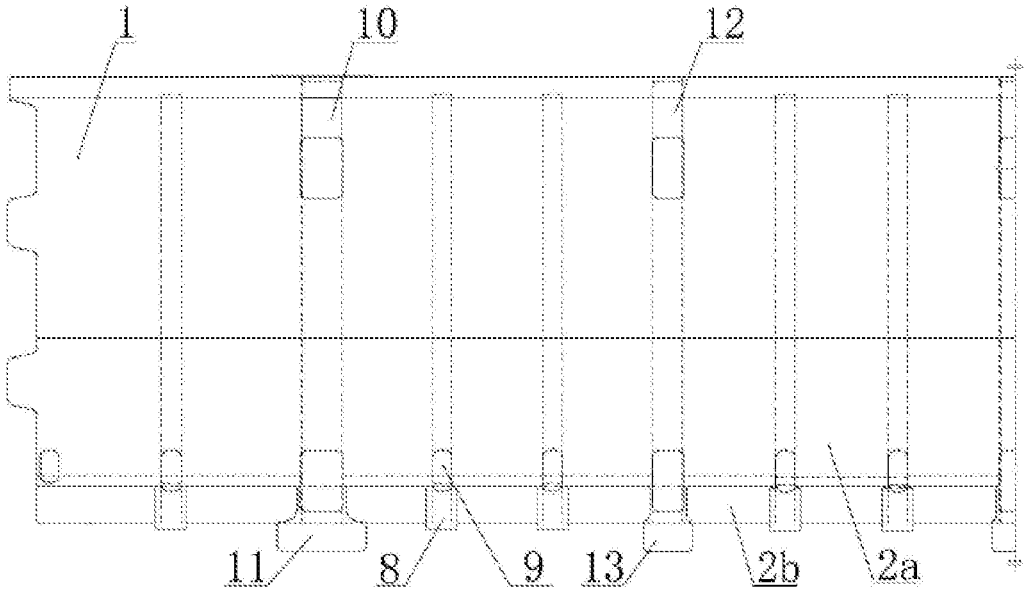
FIG. 1 is a schematic diagram of a front structure of the present invention.
Figure 2:
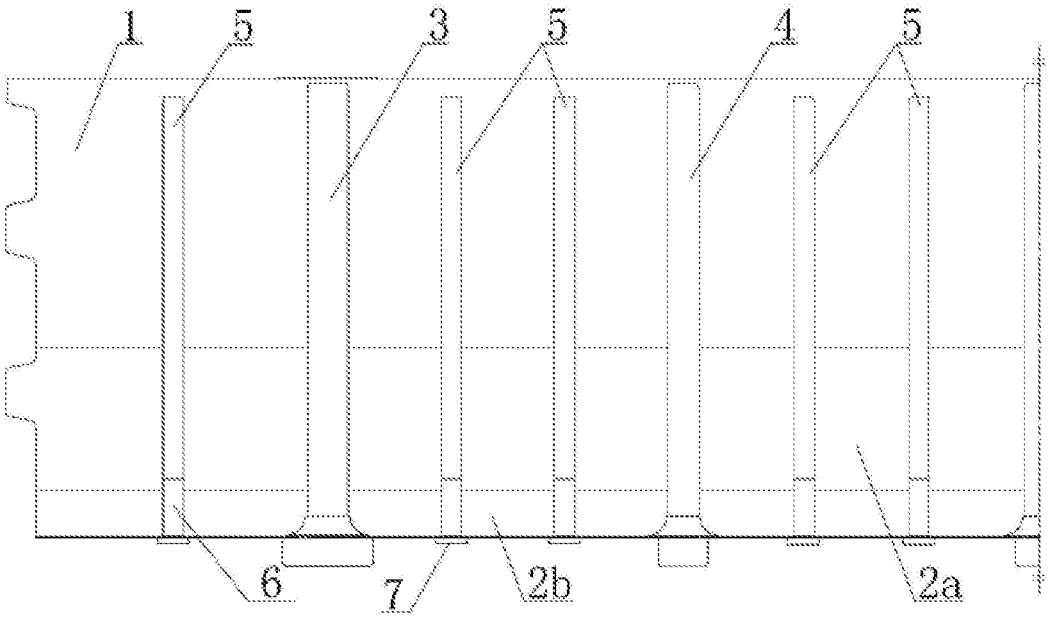
FIG. 2 is a schematic diagram of a rear view structure of FIG. 1.
Figure 3:
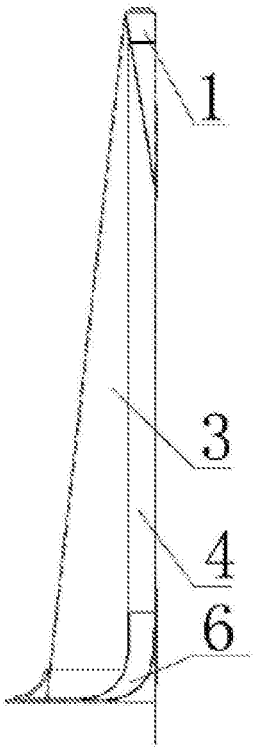
FIG. 3 is a schematic diagram of a left view structure of FIG. 1.
Figure 4:
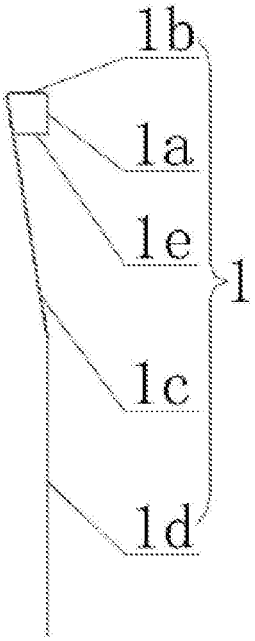
FIG. 4 is a structural schematic diagram of an upper side beam in FIG. 3.
Figure 5:
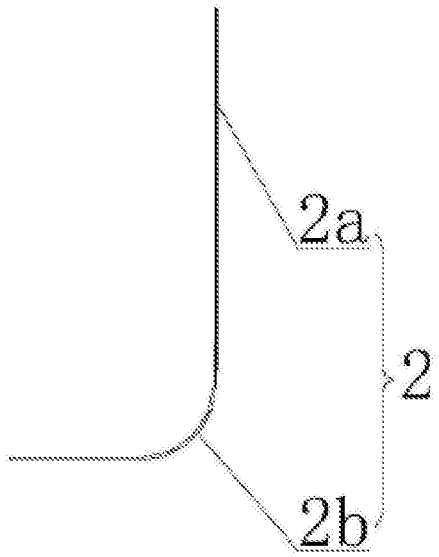
FIG. 5 is a structural schematic diagram of a side wall plate in FIG. 3.
Figure 6:
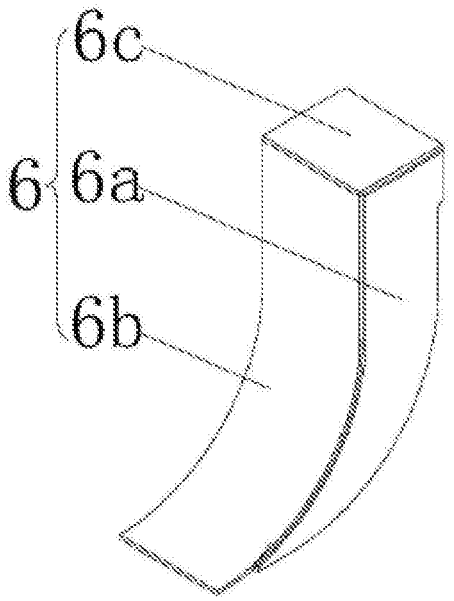
FIG. 6 is a structural schematic diagram of a base in FIG. 3.
Figure 7:
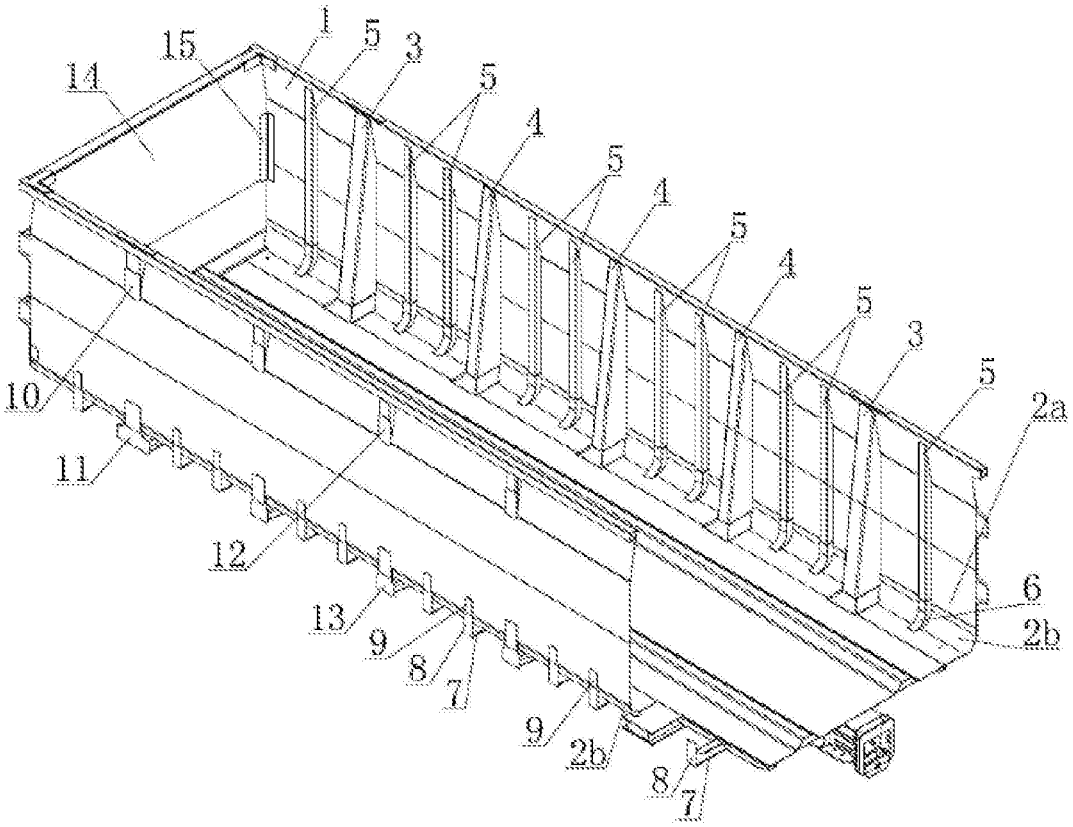
FIG. 7 is a structural schematic diagram of a use state of the present invention.
Figure 8:
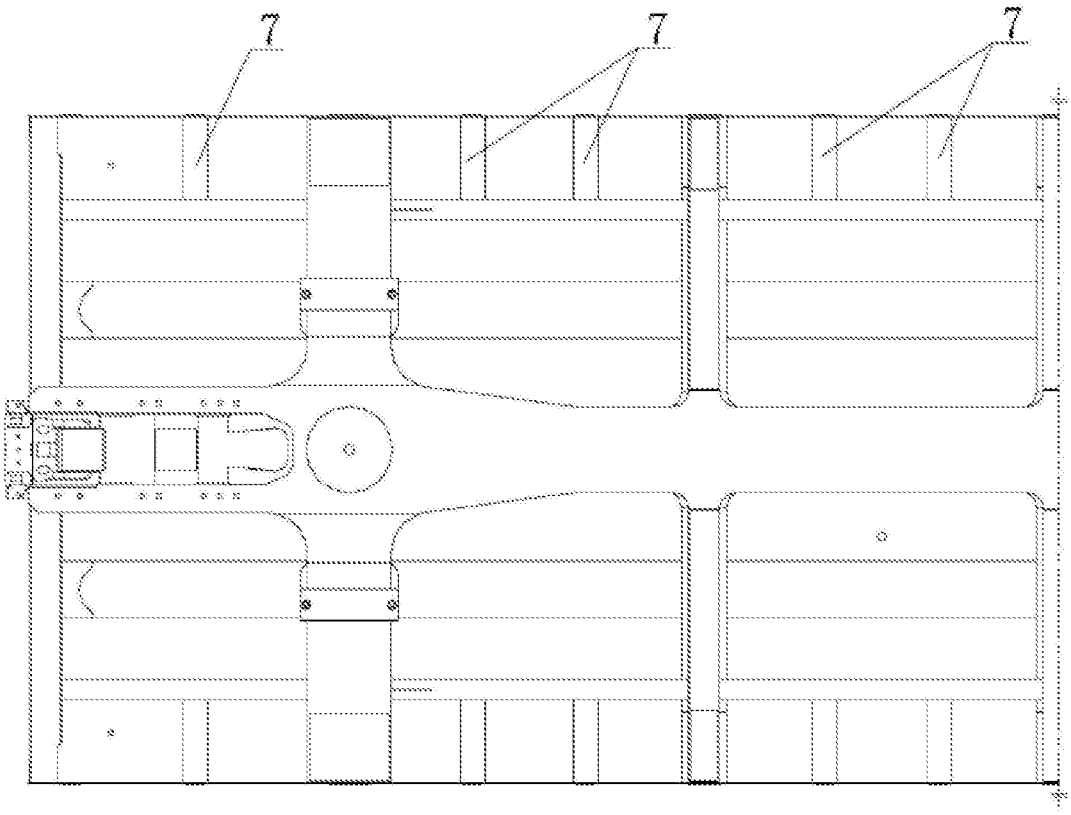
FIG. 8 is a schematic diagram of a partial bottom view structure of FIG. 7.

Upper side beam 1, outer side flanged plate 1*a*, upper planar plate 1*b*, inner side slope plate 1*c*, lower vertical plate 1*d*, sealing plate 1*e*, side wall plate 2, straight side wall plate 2*a*, arc-shaped plate 2*b*, built-in pillow column 3, built-in side column 4, built-in small upright column 5, base 6, base arc-shaped plate 6*a*, base connecting plate 6*b*, butt joint flat plate 6*c*, small cross beam 7, force transfer plate 8, intermediate backup plate 9, pillow column connecting base 10, pillow column sealing plate 11, side column connecting base 12, side column sealing plate 13, end wall 14, and angle iron 15.

DETAILED DESCRIPTION OF THE EMBODIMENTS

Exemplary embodiments of the present disclosure will be described in more detail below with reference to the drawings. Although the exemplary embodiments of the present disclosure are shown in the drawings, it should be understood that the present disclosure may be embodied in various forms rather than being limited to the embodiments set forth herein. On the contrary, these embodiments are provided to enable a more thorough understanding of the present disclosure and to provide a complete description of the scope of the present disclosure to those skilled in the art.

A side wall structure of an open wagon as shown in FIG. 1 includes an upper side beam 1 and side wall plates 2, built-in pillow columns 3 and built-in side columns 4 are arranged on the inner side of the upper side beam 1 along the longitudinal direction, the upper side beam 1 is formed by integrally pressing an outer side flanged plate 1*a*, an upper planar plate 1*b*, an inner side slope plate 1*c* and a lower vertical plate 1*d*, open edges at upper parts of the built-in pillow columns 3 and the built-in side columns 4 are welded on the inner side slope plate 1*c* and the lower vertical plate 1*d*, built-in small upright columns 5 are respectively arranged on the outer sides of the built-in pillow columns 3, between the built-in pillow columns 3 and the built-in side columns 4 that are adjacent and between every two adjacent built-in side columns 4, and the open edges of the upper parts of the built-in small upright columns 5 are also welded on the inner side slope plate 1*c* and the lower vertical plate 1*d*; and each side wall plate 2 includes a straight side wall plate 2*a* of a flat plate structure on the whole and arc-shaped plates 2*b* of arc-shaped small block structures, the open edges of a part of the lower parts of the built-in pillow columns 3, a part of the lower parts of the built-in side columns 4 and the entire lower parts of the built-in small upright columns 5 are respectively welded on the straight side wall plate 2*a*, a plurality of arc-shaped plates 2*b* are respectively welded between the built-in pillow columns 3 and the built-in side columns 4 that are adjacent and between every two adjacent built-in side columns 4, an upper end of the straight side wall plate 2*a* is in butt joint with a lower end of the lower vertical plate 1*d*, the lower end of the straight side wall plate 2*a* is in butt joint with upper ends of the arc-shaped plates 2*b*, and the lower ends of the arc-shaped plates 2*b* are welded with a wagon body floor. The built-in small upright columns 5 are respectively arranged on the outer sides of the built-in pillow columns 3, between the built-in pillow columns 3 and the built-in side columns 4 that are adjacent and between every two adjacent built-in side columns 4 to reinforce the support to the side wall plate 2 so as to greatly improve the strength and the rigidity of the side wall structure, in this way, the side wall plate 2 does not need to be pressed anymore, thereby reducing the workload and improving the assembly efficiency; and meanwhile, as the side wall plate 2 is designed into the structure composed of the straight side wall plate 2*a* and the arc-shaped plates 2*b*, the upper part of the side wall plate 2 is of an integral structure, thereby improving the strength and the rigidity of the side wall structure, moreover, after the upper part of the side wall plate 2 is designed into the integral structure, the number of the assembled parts is reduced, and the assembly efficiency is improved.

One built-in small upright column 5 is arranged on each of the outer sides of the built-in pillow columns 3, and two built-in small upright columns 5 are respectively arranged between the built-in pillow columns 3 and the built-in side columns 4 that are adjacent and between every two adjacent built-in side columns 4. The lower ends of the built-in small upright columns 5 are connected with the arc-shaped plates 2*b* by a base 6; the base 6 is formed by splicing two base arc-shaped plates 6*a* and one base connecting plate 6*b*, arc-shaped side edges of the base arc-shaped plates 6*a* are matched with the arc-shaped plates 2*b*, the upper end of the base 6 is in butt joint with the lower ends of the built-in small upright columns 5, and an arc-shaped opening of the base 6 is in butt joint with the arc-shaped plates 2*b*. As the base 6 is additionally arranged at the lower ends of the built-in small upright columns 5, the base 6 connects the built-in small upright columns 5, the straight side wall plate 2*a* and the arc-shaped plates 2*b* into an entirety, thereby further improving the strength and the rigidity of the side wall structure. To facilitate the butt joint of the built-in small upright columns 5 and the base 6, a butt joint flat plate 6*c* may be additionally arranged at the upper end of the base 6.

Small cross beams 7 connected with a longitudinal wagon body beam are respectively arranged at positions corresponding to the built-in small upright columns 5 on the bottom surface of the wagon body floor. As the small cross beams 7 connected with the longitudinal wagon body beam are respectively arranged at positions corresponding to the built-in small upright columns 5 on the bottom surface of the wagon body floor, the stress applied to the side wall plate 2 can be transferred onto the small cross beams 7 by the built-in small upright columns 5, the base 6 and the arc-shaped plates 2*b* and is finally transferred onto the longitudinal wagon body beam by the small cross beams 7, thereby improving the load that can be born by the side wall structure. Force transfer plates 8 are respectively arranged at positions corresponding to the built-in small upright columns 5 on the outer sides of the arc-shaped plates 2*b*, the upper ends of the force transfer plates 8 are welded on the outer sides of the arc-shaped plates 2*b*, and the lower ends of the force transfer plates 8 are welded with the small cross beams 7. The additionally arranged force transfer plates 8 can better transfer the stress applied to the side wall plate 2 to the small cross beams 7, thereby further improving the load that can be born by the side wall structure.

Intermediate wagon backup plates 9 are respectively arranged at positions corresponding to the built-in small upright columns 5 on the outer side of the straight side wall plate 2*a*, the upper ends of the intermediate wagon backup plates 9 are welded on the straight side wall plate 2*a*, and the lower ends of the intermediate wagon backup plates 9 are welded on the force transfer plates 8. The additionally arranged intermediate wagon backup plates 9 can effectively avoid a car dumper and other mechanical equipment from damaging the side wall structure in loading and unloading of cargos.

Pillow column connecting bases 10 are arranged on the outer sides of the upper parts of the built-in pillow columns 3, the upper ends of the pillow column connecting bases 10 are in welded connection with the lower end of the outer side flanged plate 1*a*, and the lower ends of the pillow column connecting bases 10 are in welded connection with the lower end of the inner side slope plate 1*c*; and pillow column sealing plates 11 are arranged at the outer sides of the lower parts of the built-in pillow columns 3, the upper ends of the pillow column sealing plates 11 are in welded connection with the lower end of the straight side wall plate 2*a*, and the inner sides of the lower ends of the pillow column sealing plates 11 are welded with the open edges of the built-in pillow columns 3 and the end parts of wagon body pillow beams at the same time. The additionally arranged pillow column connecting bases 10 and the pillow column sealing plates 11 increase the overall strength and the rigidity of the side wall structure to enable the side wall structure to uniformly bear the lateral pressures of the loaded cargos and the transverse force of the running wagon on one hand, and improve the aesthetic feeling of the appearance design and the cleanness of the wagon body on the other hand.

Side column connecting bases 12 are arranged on the outer sides of the upper parts of the built-in side columns 4, the upper ends of the side column connecting bases 12 are in welded connection with the outer side flanged plate 1*a*, and the lower ends of the side column connecting bases 12 are in welded connection with the lower end of the inner side slope plate 1*c*; and side column sealing plates 13 are arranged at the outer sides of the lower parts of the built-in side columns 4, the upper ends of the side column sealing plates 13 are in welded connection with the lower end of the straight side wall plate 2*a*, and the inner sides of the lower ends of the side column sealing plates 13 are welded with the open edges of the built-in side columns 4 and the end parts of cross wagon body beams at the same time. The additionally arranged side column connecting bases 12 and the side column sealing plates 13 increase the overall strength and the rigidity of the side wall structure to enable the side wall structure to uniformly bear the lateral pressures of the loaded cargos and the transverse force of the running wagon on one hand, and improve the aesthetic feeling of the appearance design and the cleanness of the wagon body on the other hand.

A horizontally arranged sealing plate 1*e* is arranged at the lower end of the outer side flanged plate 1*a*, one side edge of the sealing plate 1*e* is in butt joint with the lower end of the outer side flanged plate 1*a*, the other side edge of the sealing plate 1*e* is in butt joint with an outer side face of the inner side slope plate 1*c*, and the outer side flanged plate 1*a*, the upper planar plate 1*b*, the inner side slope plate 1*c* and the sealing plate 1*e* form a closed cavity. As the flanging structure of the upper side beam 1 is sealed by the sealing plate 1*e* to form the closed cavity, the strength and the rigidity of the upper side beam 1 are greatly improved. Angle irons 15 for connecting end walls 14 are respectively arranged at both ends of the upper side beam 1. After the built-in small upright columns 5 are additionally arranged and the flanging structure of the upper side beam 1 is closed, the strength and the rigidity of the side wall structure are greatly improved, therefore the corner columns necessary for installing the end walls can be cancelled. However, to ensure the strength, the angle irons 15 for connecting the end walls 14 are still respectively arranged at both ends of the upper side beam 1 of the side wall structure, thereby greatly simplifying the structure of the wagon body and improving the assembly efficiency on the premise of guaranteeing the strength and the rigidity.

Circular arc-shaped protection plates are welded on the peripheries of the bottoms of the built-in pillow columns 3 and the built-in side columns 4, the circular arc-shaped protection plates are also in welded connection with the wagon body floor, and meanwhile, the lower ends of the built-in pillow columns 3 and the built-in side columns 4 are respectively welded with their corresponding pillow beam upper cover plates and cross beam upper cover plate after penetrating through the wagon body floor. For other unmentioned structures of the side wall structure, reference can be made to the wagon body side wall structure of a railway ore open wagon disclosed by Chinese Patent No. 201220680175.8.

The built-in small upright columns 5 are respectively arranged on the outer sides of the built-in pillow columns 3, between the built-in pillow columns 3 and the built-in side columns 4 that are adjacent and between every two adjacent built-in side columns 4 to reinforce the support to the side wall plate 2 so as to greatly improve the strength and the rigidity of the side wall structure, in this way, the side wall plate does not need to be pressed anymore, thereby reducing the workload and improving the assembly efficiency. As the side wall plate 2 is designed into the structure composed of the straight side wall plate 2*a* and the arc-shaped plates 2*b*, the upper part of the side wall plate 2 is of an integral structure, thereby improving the strength and the rigidity of the side wall structure; moreover, after the upper part of the side wall plate 2 is designed into the integral structure, the number of the assembled parts is reduced, and the assembly efficiency is improved. As the base 6 is additionally arranged at the lower ends of the built-in small upright columns 5, the base 6 connects the built-in small upright columns 5, the straight side wall plate 2*a* and the arc-shaped plates 2*b* into an entirety, thereby further improving the strength and the rigidity of the side wall structure. As the small cross beams 7 connected with the longitudinal wagon body beam are respectively arranged at positions corresponding to the built-in small upright columns 5 on the bottom surface of the wagon body floor, the stress applied to the side wall plate 2 can be transferred onto the small cross beams 7 by the built-in small upright columns 5, the base 6 and the arc-shaped plates 2*b* and is finally transferred onto the longitudinal wagon body beam by the small cross beams 7, thereby improving the load that can be born by the side wall structure. The additionally arranged force transfer plates 8 can better transfer the stress applied to the side wall plate 2 to the small cross beams 7, thereby further improving the load that can be born by the side wall structure. The additionally arranged intermediate wagon backup plates 9 can effectively prevent the car dumper and other mechanical equipment from damaging the side wall structure in loading and unloading of cargos; the additionally arranged pillow column connecting bases 10, the pillow column sealing plates 11, the side column connecting bases 12 and the side column sealing plates 13 increase the overall strength and the rigidity of the side wall structure to enable the side wall structure to uniformly bear the lateral pressures of the loaded cargos and the transverse force of the running wagon on one hand, and improve the aesthetic feeling of the appearance design and the cleanness of the wagon body on the other hand. As the flanging structure of the upper side beam 1 is sealed by the sealing plate 1*e* to form the closed cavity, the strength and the rigidity of the upper side beam 1 are greatly improved; and after the built-in small upright columns 5 are additionally arranged and the flanging structure of the upper side beam 1 is closed, the strength and the rigidity of the side wall structure are greatly improved, therefore the corner columns necessary for installing the end walls can be cancelled. However, to ensure the strength, the angle irons 15 for connecting the end walls 14 are still arranged at both ends of the upper side beam 1 of the side wall structure, thereby greatly simplifying the structure of the wagon body and improving the assembly efficiency on the premise of guaranteeing the strength and the rigidity.

The present invention is suitable for various open wagons, such as railway ore open wagons and railway freight open wagons, etc.

The invention claimed is:

1. A side wall structure of an open wagon, comprising:

an upper side beam (1) formed by integrally pressing an outer side flanged plate (1*a*), an upper planar plate (1*b*), an inner side slope plate (1*c*) and a lower vertical plate (1*d*);

a plurality of side wall plates (2), wherein each side wall plate (2) comprises a straight side wall plate (2*a*) of a flat plate structure on the arc-shaped plates (2*b*) of arc-shaped small block structures;

a plurality of built-in pillow columns (3), wherein a plurality of built-in small upright columns (5) are respectively arranged on the outer sides of the plurality of built-in pillow columns (3); and a plurality of built-in side columns (4) being arranged on the inner side of the upper side beam (1), wherein the plurality of built-in pillow columns (3), the plurality of built-in side columns (4) and the plurality of built-in small upright columns (5) are respectively welded on the straight side wall plate (2*a*), a plurality of arc-shaped plates (2*b*) are respectively welded between the plurality of built-in pillow columns (3) and the plurality of built-in side columns (4).

2. The side wall structure of the open wagon of claim 1, wherein one built-in small upright column (5) is respectively arranged on the outer sides of the plurality of built-in pillow columns (3), and two built-in small upright columns (5) are respectively arranged between the plurality of built-in pillow columns (3) and the plurality of built-in side columns (4) that are adjacent and between every two adjacent built-in side columns (4).

3. The side wall structure of the open wagon of claim 1, wherein the lower ends of the plurality of built-in small upright columns (5) are connected with the arc-shaped plates (2*b*) by a base (6).

4. The side wall structure of the open wagon of claim 3, wherein a plurality of small cross beams (7) are respectively arranged at positions corresponding to the plurality of built-in small upright columns (5) on the bottom surface of the wagon body floor.

5. The side wall structure of the open wagon of claim 4, wherein a plurality of force transfer plates (8) are respectively arranged at positions corresponding to the plurality of built-in small upright columns (5) on the outer sides of the arc-shaped plates (2*b*), the upper ends of the plurality of force transfer plates (8) are welded on the outer sides of the arc-shaped plates (2*b*), and the lower ends of the plurality of force transfer plates (8) are welded with the plurality of small cross beams (7).

6. The side wall structure of the open wagon of claim 5, wherein a plurality of intermediate wagon backup plates (9) are respectively arranged at positions corresponding to the plurality of built-in small upright columns (5) on the outer side of the straight side wall plate (2*a*).

7. The side wall structure of the open wagon of claim 1, wherein a plurality of pillow column connecting bases (10) are arranged on the outer sides of the upper parts of the plurality of built-in pillow columns (3).

8. The side wall structure of the open wagon of claim 1, wherein a plurality of side column connecting bases (12) are arranged on the outer sides of the upper parts of the plurality of built-in side columns (4).

9. The side wall structure of the open wagon of claim 1, wherein a horizontally arranged sealing plate (1*e*) is arranged at the lower end of the outer side flanged plate (1*a*).

10. The side wall structure of the open wagon of claim 9, wherein a plurality of angle irons (15) for connecting end walls (14) are respectively arranged at both ends of the upper side beam (1).

* * * * *